United States Patent [19]

McAllister et al.

[11] Patent Number: 5,064,067

[45] Date of Patent: Nov. 12, 1991

[54] CHRISTMAS LIGHT ORGANIZER

[76] Inventors: James D. McAllister; Molly J. McAllister, both of 2365 Birch La., Eugene, Oreg. 97403

[21] Appl. No.: 583,690

[22] Filed: Sep. 17, 1990

[51] Int. Cl.[5] ..... B65D 85/42

[52] U.S. Cl. ..... 206/420; 206/806; 211/26; 242/85.1

[58] Field of Search ..... 206/418, 419, 420, 806, 206/822, 495, 389, 408; 211/26, 13; 242/96, 85.1

[56] References Cited

U.S. PATENT DOCUMENTS

| | | | |
|---|---|---|---|
| 2,142,529 | 1/1939 | White | 242/85.1 |
| 2,287,368 | 6/1942 | Anderson | 242/85.1 |
| 2,917,619 | 12/1959 | Petrick | 206/419 X |
| 2,984,347 | 5/1961 | Kalinchuk | 206/419 |
| 3,592,343 | 7/1971 | Swett | 211/13 X |
| 3,626,495 | 12/1971 | Bastian, Jr. | 242/85.1 |
| 4,890,730 | 1/1990 | Kovac | 206/495 X |
| 4,917,323 | 4/1990 | Wing | 206/419 X |
| 4,971,200 | 11/1990 | Huang et al. | 206/420 |

*Primary Examiner*—Paul T. Sewell
*Assistant Examiner*—Jacob K. Ackun, Jr.
*Attorney, Agent, or Firm*—John F. Ingman

[57] ABSTRACT

A Christmas light organizer provides a frame for the handling and storage of a string of Christmas lights. A generally rectangular, planar frame includes two opposing sides having a series of tooth-like projections extending outwardly from the frame which are longitudinally bevelled, having an inner gap between projections at their base which is less than a least thickness of the electric cord and an outer gap at their ends which is greater than the greatest thickness of the electric cord, thereby allowing a Christmas light cord to be inserted and guided between the converging faces of adjacent projections until the cord is securely gripped therebetween. The other two, non-toothed, sides may have one or more sets of divergent, slanted notches intruding from the inner side of the frame and formed so as to hold, at the plug, an end of the electric cord. A handle may extend outwardly from one of the non-toothed sides. Cross braces may be added across the inside of the frame for both strength and safety.

6 Claims, 1 Drawing Sheet

CHRISTMAS LIGHT ORGANIZER

BACKGROUND OF THE INVENTION

1. Field of the Invention

This invention involves a Christmas light organizer, and, more particularly, a frame designed to securely hold a string of Christmas lights while not in use.

2. Description of the Prior Art

It is a common occurrence for Christmas lights, having been removed from the Christmas tree or outdoor display, to be simply dumped in a pile for storage pending the next holiday season. This generally results in a severely tangled condition, requiring considerable effort to straighten out prior to next use.

Furthermore, the handling of a long string of lights, particularly in the decorating or undecorating of a Christmas tree, is made considerably more difficult by the need to control the free length while circling about the tree.

What is needed is a Christmas light organizer which:

a. provides convenient, untangled, and secure storage of strings of Christmas lights between holiday seasons;

b. is easily handled;

c. facilitates the putting-up and removal of lights by controlling the free length of the string during such operations;

d. is inexpensive to manufacture.

SUMMARY OF THE INVENTION

The present invention provides a Christmas light organizer which meets the aforementioned need. A frame is provided having a plurality of tooth-like projections on opposing sides to receive the electric cord of the string of lights.

Accordingly, in the preferred embodiment, the Christmas light organizer includes a generally rectangular, planar frame where two opposing sides have a series of tooth-like projections extending outwardly. The tooth-like projections, preferred for general Christmas light use, extend 7/16-inch from the frame and are longitudinally bevelled, having an inner gap between projections at their base of ⅛-inch and an outer gap at their ends of ¼-inch, thereby allowing a Christmas light cord to be inserted and guided between the converging faces of adjacent projections until the cord is securely gripped therebetween. The other two, non-toothed, sides may have one or more sets of divergent, slanted notches intruding from the inner side of the frame and formed so as to hold, at the plug, an end of the electric cord. A handle may extend outwardly from one of the non-toothed sides. Cross braces may be added across the inside of the frame for both strength and safety.

DESCRIPTION OF THE PREFERRED EMBODIMENT

Figure 1:
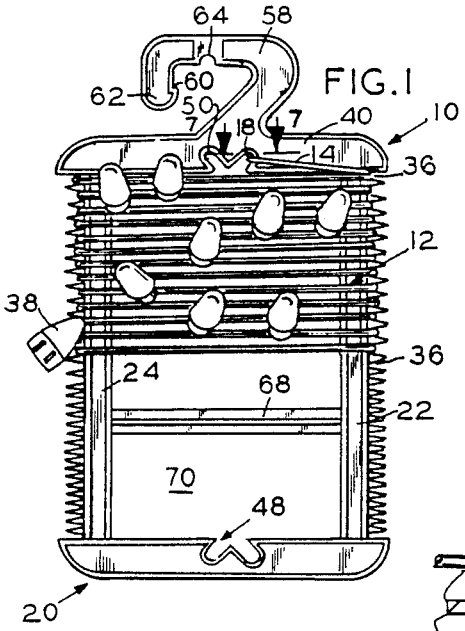
FIG. 1 illustrates a Christmas light organizer which is partially wrapped with a light string.

Turning now to the drawings, there is shown in FIG. 1 a Christmas light organizer 10 in use, being partially loaded with a Christmas light string 12. As illustrated, the light string 12 extends from a slanted notch 50 in the top frame member 40 of the organizer 10, the plug 16 being located directly behind the notch 50 and the electric cord 14 extending therethrough and directed toward a side member 22 so as to hold the plug 16 and end 18 of the cord 14 in the notch 50. The cord 14 subsequently is wrapped about the frame 20 by insertion into converging spaces 36 between adjacent tooth-like projections 26 in the two side members 22 and 24.

Figure 4:
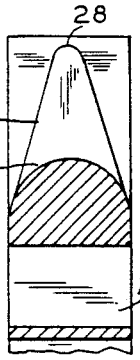
FIG. 4 illustrates an enlarged side view of the tooth-like projection, as seen at line 4—4 of FIG. 2.
Figure 5:
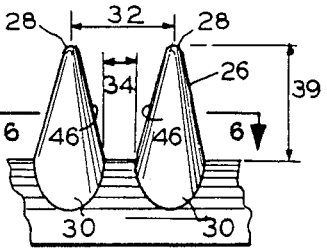
FIG. 5 illustrates a side view of a pair of adjacent tooth-like projections, as seen at line 5—5 of FIG. 6.
Figure 6:
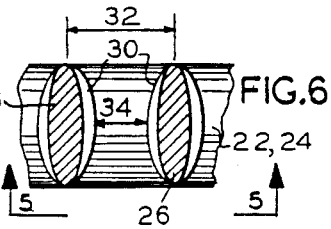
FIG. 6 illustrates a cross sectional end view of a pair of tooth-like projections, as seen at line 6—6 of FIG. 5.
Figure 7:
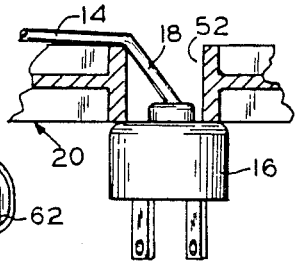
FIG. 7 illustrates a cross sectional view of an electric cord and plug held at a notch, as seen at line 7—7 of FIG. 1.
Figure 2:
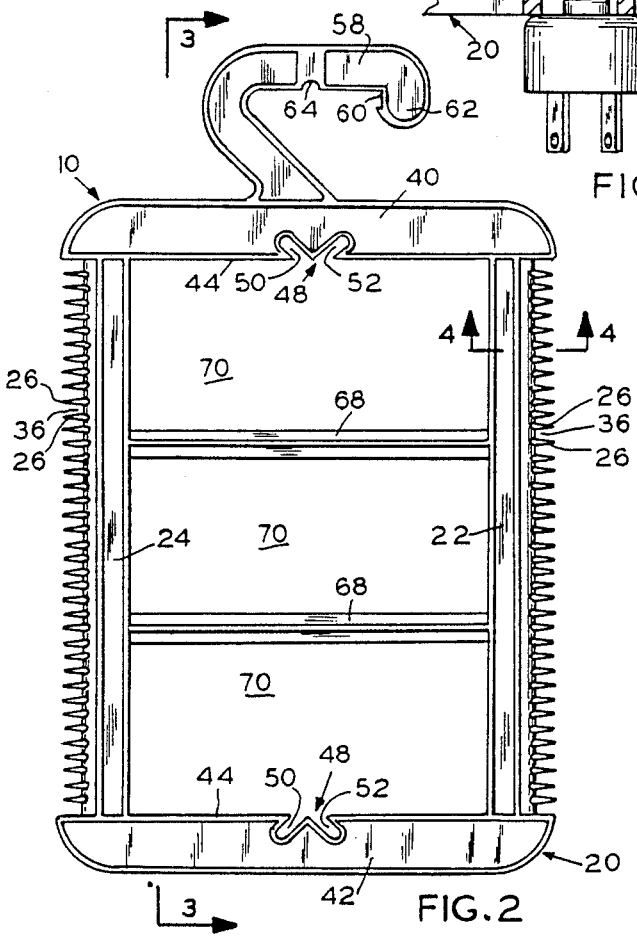
FIG. 2 illustrates a side elevational view of the Christmas light organizer.
Figure 3:
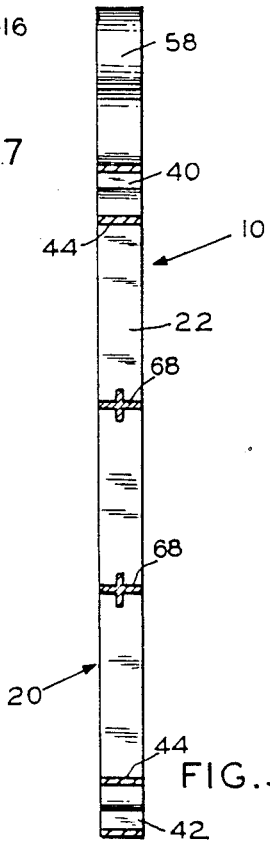
FIG. 3 illustrates a cross sectional view as seen at line 3—3 of FIG. 2.

FIG. 2 illustrates the Christmas light organizer 10, without light string 12, in its preferred embodiment. A generally rectangular, planar frame 20 includes two opposing side members 22 and 24, each of which has a series of tooth-like projections 26 extending outwardly therefrom. Each tooth-like projection 26, better seen in FIGS. 4 through 6, is longitudinally bevelled so as to narrow from its base 30 towards its outer end 28. Such bevelling is important so that a portion of the electric cord 14 may be easily inserted within the outer gap 32 between the outer ends 28 of two adjacent projections 26 and slid inwards, guided by the side faces 46 of the projections 26 until the space 36 between them has narrowed sufficiently for the electric cord 14 to be securely grasped therebetween. It has been found, for conventional Christmas light strings 12 having a greatest electric cord 14 thickness of less than ¼-inch and a least cord 14 thickness of more than ⅛-inch, that a tooth-like projection 26 having a length 39 of 7/16-inch and an outer gap 32 of ⅛-inch between adjacent projections 26 narrowing to a ⅛-inch inner gap 34 at their base 30 attachment to the side member 22, 24 of the frame 20, permits easy insertion of the electric cord 14, yet the cord 14 is readily grasped by the adjacent projections 26 with a subsequent short inward movement.

The frame 20 itself may be of various dimensions, and have various numbers of opposing tooth-like projections 26. Preferred for general use is a frame 20 having an outside height of 11 ¾-inches, encompassing thirty-eight projections 26 with thirty-seven intervening spaces 36, and an outside width, including projections 26, of 8½-inches. Such dimensions allow the wrapping of a 50-foot Christmas light string 12 or combination of strings 12 on a single frame 20.

The grasping action of the tooth-like projections 26 not only allows secure storage, but also permits the organizer 10 to be used advantageously during the putting up and removal of the light string 12, wherein limited segments of cord 14 of about 8-inches in length can be released from or added to the organizer 10 at a time, allowing the wrapped portion of the light string 12 to remain under continuing control on the organizer 10.

On the top member 40 and bottom member 42 of the frame 20, formed on the inner side 44 thereof, may be one or more slanted notch sets 48, each set 48 having a pair of notches 50, 52 slanted toward, at approximately 45-degrees, the opposing side members 22, 24. Such slanted notches 50, 52 may be used to anchor the end 18 of a light string 12, where the electric cord 14, near an end 18, is placed into the notch 50 or 52 and drawn therethrough until the plug 16 abuts the frame 20. The cord 14 is then directed toward the side member 22 or 24 corresponding to the slanted direction of the notch 50 or 52, where it is grasped by between an available pair of tooth-like projections 26. Upon completion of the wrapping of a light string 12 about the organizer 10, the second end plug 38 can be secured in the same manner, or, as illustrated in FIG. 1, may be left secured between a pair of projections 26 along the side members 22, 24, or even may be tucked (not shown) between adjacent lengths of cord 14 which have been wrapped and secured about the frame 20. With the length of light string 12 illustrated, a second light string (not shown) could, if desired, be attached to plug 38 and continued to be wrapped to fill the frame 20.

A handle 58 may extend from the top member 40 of the frame 20 as a convenience for handling the organizer 10 during decorating and undecorating, or for hanging in storage. The preferred handle 58 includes a squared hook 60 formed into its outer end 62 which allows the frame 20 to be more easily secured upon a ladder, a roof gutter, or other like location. A nail or hook notch 64 may be included at the center balance of the handle 58, to aid in storage or merchandising.

Cross braces 68 may bridge the gap between the side members 22, 24 such braces 68 providing structural support to the side members 22, 24 against the pressure of tightly wrapped light strings 12, and also, significantly, providing a reduction in the dimensions of open areas 70 within the frame 20, precluding possibility that a child might slip the organizer 10 over his or her head and be injured thereby.

The Christmas light organizer 10 may be molded in a sturdy plastic, such as polypropylene, as illustrated, or may be formed from wood or other suitable material.

It is thought that the Christmas light organizer of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A Christmas light organizer, in combination with an electrical light string having a plurality of electric bulbs joined by electric cord, the organizer comprising:

a. a planar frame having two opposing sides;

b. a plurality of tooth-like projections (1) extending outwardly in linear series from each of the opposing sides;

(2) each said projection, having a base on a said side and having an outer end, being formed with an outer surface which converges from the base to the outer end;

(3) said projections being formed, and spaced from an adjacent projection, so that the respective bases are separated by a distance less than a least thickness of the electric cord and the respective outer ends are separated by a distance greater than a greatest thickness of the electric cord;

(4) so that the electric cord may be inserted between the outer ends of two adjacent projections and with continuing insertion become wedged between said adjacent projections.

2. The Christmas light organizer, as recited in claim 1, the frame having a top joining the two opposing sides, wherein a handle extends outwardly from said top of said frame, said handle being formed at its outer end with an inwardly facing squared hook for grasping an edge of a ladder, rain gutter, or the like.

3. The Christmas light organizer, as recited in claim 1, where, additionally, there is at least one cross member extending between the two opposing sides of the frame, formed for structural support of the sides and to reduce the size of any single open area within the frame.

4. The Christmas light organizer, as recited in claim 1, where, additionally, there is at least one set of slanted notches formed on an edge of a top or bottom of the frame, said set of slanted notches including two diverging notches extending outwardly from locations on said edge, each notch being slanted toward one of the two opposing sides.

5. A Christmas light organizer, in combination with an electrical light string having a plurality of electric bulbs joined by electric cord, the organizer comprising:

a. a planar open frame having two opposing side members and a top member and a bottom member joining the two opposing side members;

b. a plurality of tooth-like projections (1) extending outwardly in linear series from each of the opposing side members;

(2) each said projection, having a base on a said side member and an outer end, being formed with an outer surface which converges from the base to the outer end;

(3) said projections being formed, and spaced from an adjacent projection, so that the respective bases are separated by a distance less than a least thickness of the electric cord and the respective outer ends are separated by a distance greater than a greatest thickness of the electric cord;

(4) so that the electric cord may be inserted between the outer ends of two adjacent projections and with continuing insertion become wedged between said adjacent projections; and c. at least one set of slanted notches formed on an inside edge of a top or bottom member of the frame, said set of slanted notches including two diverging notches extending outwardly from locations on said inside edge, each notch being slanted toward one of the two opposing side members.

6. A Christmas light organizer, in combination with an electrical light string having a plurality of electric bulbs joined by electric cord, the organizer comprising:

a. a planar open frame having a top member, a bottom member, and two opposing side members, which includes:

(1) a handle, extending outwardly from said top member, being formed with an inwardly facing squared hook at its outer end for grasping an edge of a ladder, rain gutter, or the like;

(2) at least one set of slanted notches formed on an inside edge of the top or bottom member of the frame, said set of slanted notches including two diverging notches extending outwardly from locations on said inside edge, each notch being slanted toward one of the two opposing side members; and (3) at least one cross member extending between the two opposing side members of the frame, formed for structural support of the side members and to reduce the size of any single open area within the frame;

b. a plurality of tooth-like projections (1) extending outwardly in linear series from each of the opposing side members;

(2) each said projection, having a base on a said side member and an outer end, being formed with an outer surface which converges from the base to the outer end;

(3) said projections being formed, and spaced from an adjacent projection, so that the respective bases are separated by a distance less than a least thickness of the electric cord and the respective outer ends are separated by a distance greater than a greatest thickness of the electric cord;

(4) so that the electric cord may be inserted between the outer ends of two adjacent projections and with continuing insertion become wedged between said adjacent projections.

* * * * *